US005287677A

United States Patent [19]

Hunter

[11] Patent Number: 5,287,677

[45] Date of Patent: Feb. 22, 1994

[54] APPARATUS AND METHOD FOR HIGH SPEED ASSEMBLY OF BOTTLES INTO PACK CARRIERS

[75] Inventor: Charles M. Hunter, Columbus, Ohio

[73] Assignee: Abbott Laboratories, Abbott Park, Ill.

[21] Appl. No.: 23,495

[22] Filed: Feb. 26, 1993

[51] Int. Cl.[5] ..... B65B 27/04

[52] U.S. Cl. ..... 53/398; 53/48.1; 53/48.3

[58] Field of Search ..... 53/398, 48.1, 48.3

[56] References Cited

U.S. PATENT DOCUMENTS

| | | | |
|---|---|---|---|
| D. 331,194 | 11/1992 | Pezzoli et al. . | |
| D. 331,698 | 12/1992 | Pezzoli et al. . | |
| D. 331,699 | 12/1992 | Araujo, Jr. et al. . | |
| D. 332,395 | 1/1993 | Araujo, Jr. et al. . | |
| D. 332,401 | 1/1993 | Araujo, Jr. et al. . | |
| 3,144,740 | 8/1964 | Erickson et al. | 53/48.1 |
| 3,611,656 | 10/1971 | Chidsey, Jr. | 53/48.1 X |
| 3,710,535 | 1/1973 | Walter | 53/48.3 X |
| 4,078,357 | 3/1978 | Ida | 53/398 |
| 5,154,039 | 10/1992 | de Gugielmo | 53/398 |
| 5,191,975 | 3/1993 | Pezzoli et al. | 206/151 |

*Primary Examiner*—Horace M. Culver

*Attorney, Agent, or Firm*—Lonnie R. Drayer; Donald O. Nickey

[57] ABSTRACT

Capped bottles filled with a composition are loaded into pack carriers therefor in apparatus in which the bottles are conveyed in a continuous series in two spaced apart lines to respective metering starwheels, each with an associated application starwheel, and each starwheel with an associated retentive curved guide means along an arc thereof, at a loading zone while a continuous series of the pack carriers or clips are advanced on a conveyor between the bottle lines to the loading zone. At the loading zone the respective metering starwheels each move the bottles consecutively past the guide means to the associated application starwheel and the application starwheels are mutually spaced sufficiently close on either side of each pack carrier passing in between them to force successive bottles simultaneously from each line into the respective back to back pockets. The arms of the application starwheels during rotation act upon the pair of bottles just inserted to advance the pack carrier on a flat surface and index the pack carrier for the insertion of each successive back to back pair of bottles and then to move the loaded pack carrier to a discharge point or to another conveyor for further handling. The bottles during transport by the starwheels are carried thereby, the bottle rims just below the caps or other upper enlargements of the bottles resting on the upper edges of the starwheels. The apparatus and method are capable of loading up to 1000 bottles per minute, depending on bottle size.

15 Claims, 14 Drawing Sheets

APPARATUS AND METHOD FOR HIGH SPEED ASSEMBLY OF BOTTLES INTO PACK CARRIERS

FIELD OF THE INVENTION

The invention relates to apparatus and method for high speed assembly of bottles into pack carriers therefor, and more particularly, the high speed assembly of filled bottles containing a composition such as a dietary formulation or nutritional supplement into sturdy pack carriers in which the bottles are resiliently insertable and removable.

BACKGROUND OF THE INVENTION

Various pack carriers are known for the packaging and transport of items such as bottles and cans of beverages like soft drinks and beer, or small electric light bulbs like those used on Christmas trees. These pack carriers usually encircle the neck of the item and are made of somewhat flexible plastic material or cardboard or other paper product. And it is believed that these pack carriers are filled or loaded manually, or the pack carrier is formed or shrunk around the item.

A novel type of pack carrier particularly adapted for storing and transporting a plurality of individual serving size, or larger, containers of, e.g., dietary formulations or nutritional supplements, or other liquid products, is described in to be pending U.S. Pat. No. 5,191,975. This pack carrier is characterized by having a longitudinal central section with a plurality of laterally extending, back to back, means for gripping and resiliently holding containers of uniform size and shape, typically four to eight containers per pack carrier. The means for gripping each container consists of a pair of opposed gripping members, each pair forming an opening for receiving and retaining a container. Such pack carriers are preferably formed of a durable polymeric composition so as to be reliable, durable and/or sterilizable and reusable. Suitable materials of construction for the pack carriers include clear polyethylene terephthalate glycol copolymer, high impact polystyrene, polyvinyl chloride and polyethylene terephthalate or other polymeric materials that are durable and suitable for molding the pack carrier in a single piece. The pack carriers may also be formed of a heavy gauge wire or light rod that is springy in character, usually of a ferrous metal. Such pack carriers are taught in U.S. Pat. Nos. 331,194, 331,698, 331,699 and 332,401. An assembly of such a pack carrier and a plurality of containers is taught in U.S. Pat. No. 332,395.

It is desired to provide a suitable apparatus and method for high speed assembly of capped containers, filled with a liquid composition, into pack carriers with characteristics like or similar to those of the pack carriers described in the pending patent application and the various design patents. So far as is known, no such apparatus and method exist.

SUMMARY OF THE INVENTION

The present invention is directed to an apparatus for high speed assembly of capped bottles, while filled with a composition, side-loading them into pack carriers therefor wherein the bottles to be assembled are of substantially the same size and shape and have a substantially cylindrical no-neck body, or a cylindrical neck portion, and have a closure, such as an externally threaded closure with a lower rim that is larger in diameter than the no-neck body or the cylindrical neck portion, or, the bottles may have a pack carrier-receiving annular groove above about the mid-height of the bottle, and the pack carriers have a longitudinal central section, or spine, from which extend a plurality of back to back aligned pairs of laterally opening clips or pockets into which the bodies or necks or the annular groove of the bottles are resiliently inserted sideways and held.

The apparatus is comprised of: a loading station between two spaced apart application starwheels, each with at least three co-axially spaced, star-shaped elements on a common rotatable shaft and each with associated curved guide means to retain bottles in the pockets thereof along a circumferential arc;

power means for controllably and coordinately rotating the two application starwheels simultaneously;

means for feeding a consecutive single file series of pack carriers midway between the two application starwheels in the longitudinal direction thereof the pack carriers and at a level between the upper two star-shaped elements of each application starwheel, the two application starwheels being sufficiently close together that the deepest parts of the pockets between the arms of the star-shaped elements are substantially a bottle no-neck body or neck or annular groove diameter width from the deepest parts of the pockets of a pack carrier to be passed therebetween, and the arc of each of the guide means extending along the upstream side of its associated application starwheel substantially to the path of the pack carriers, and the arms of the application starwheels moving in the downstream direction when rotated with the arms extending immediately above or below the path of the pack carriers;

means for supplying first and second respective consecutive single file series of the bottles to the application starwheels, respectively;

indexing means for closely aligning the pockets of advancing pack carriers with the pockets of the application starwheels rotating during such advancing, the pockets between the arms of the star-shaped elements being shaped to provide a cam-like action to force each bottle carried in a pocket of each application starwheel into an aligned pocket of a pack carrier moving between the application starwheel, the indexing means providing for simultaneously forcing bottles into back to back pockets of the pack carriers; and the arms of the star-shaped elements during rotation being adapted to bear against successive nested bottles just loaded into a pack carrier to move the pack carrier an incremental distance to be aligned to receive the next pair of bottles until the pack carrier is loaded and pushed out of the loading station to a discharge point.

Generally the bottles are supplied single file by respective first and second conveyors, preferably to respective chutes in which the bottles slide along, suspended, by the lower rim of the closure or other larger diameter structural edge of the bottle just above the pack carrier pocket-receiving no-neck or neck portion or annular groove, from the top edges of the chutes, to respective metering starwheels with opposed guide means for carrying and feeding the bottles coordinately to the respective application starwheels, while the pack carriers are supplied by a third conveyor in single file in the longitudinal direction to the loading station where they are slid, by the pushing action of the pack carriers that follow on the conveyor, across a flat slidable surface during loading. The loaded pack carriers leaving the application starwheels are supported by the bottles nested in them, the bottles and carrier sliding to a discharge point on a lower slidable surface, usually to a fourth conveyor transporting the loaded carriers to inspection and to means for packaging.

The method of the invention contemplates providing, within a loading station, two laterally spaced apart application starwheels, each with at least three coaxially spaced, star-shaped elements upon an axial shaft, controllable power means for coordinated rotation of the axial shafts, and associated curved guide means adjacent each application starwheel, the star-shaped elements having arms and pockets therebetween;

advancing to the loading station and sliding upon an upper slidable surface positioned between the application starwheels a substantially contiguous single file series of pack carriers oriented in the longitudinal direction, each having a central longitudinal section with a plurality of laterally extending, back to back, means for gripping and resiliently holding containers, or bottles, of uniform size and shape with cylindrical no-neck bodies or neck portions or annular grooves, the means for gripping each consisting of opposed gripping members, each pair forming a pocket for receiving and retaining a bottle by the no-neck or neck or annular groove portion;

supplying to each respective application starwheel and its associated guide means a single file consecutive series of bottles each filled with a composition and closed with a cap, such as a screw cap, the bottles with a no-neck body or a neck having a closure with a rim below the cap that is larger in diameter than the body or the neck, the bottles being presented consecutively and positioned so as to fit between the guide means and consecutive pockets between arms of the star-shaped elements and ride on the starwheel with the rim, or the body portion above the annular groove, overlapping the upper edge of the uppermost star-shaped element;

rotating coordinately the two application starwheels with the arms of the star-shaped elements extending just above or below the path of the adjacent pockets of the pack carriers being slid in between and the so-extending arms moving in the downstream direction during rotation, and the spacing between each application starwheel and each adjacent pack carrier sliding through the loading station being such that there is a no-neck body or neck or annular groove diameter distance between the pockets of each of the application starwheels and the successive adjacent pockets of the pack carrier at closest coordinated and indexed approach, and thereby inserting consecutive bottles into consecutive pockets on each side of the pack carrier, the back to back pockets being filled or loaded simultaneously, and arms of the star-shaped elements engaging the just-inserted bottles, bottle by bottle, simultaneously on both side of the pack carrier, each time moving the pack carrier incrementally downstream and indexing the same to receive the next pair of bottles, and finally advancing each loaded pack carrier in turn out of the loading station, permitting the following pack carrier to advance contiguously in indexed fashion.

BRIEF DESCRIPTION OF THE DRAWINGS

The features of the present invention which are believed to be novel are set forth with particularity in the appended claims. The present invention, both as to its structure and manner of operation, may best be understood by reference to the following detailed description, taken in accordance with the accompanying drawings in which:

DETAILED DESCRIPTION OF THE INVENTION

Figures 1, 1A:
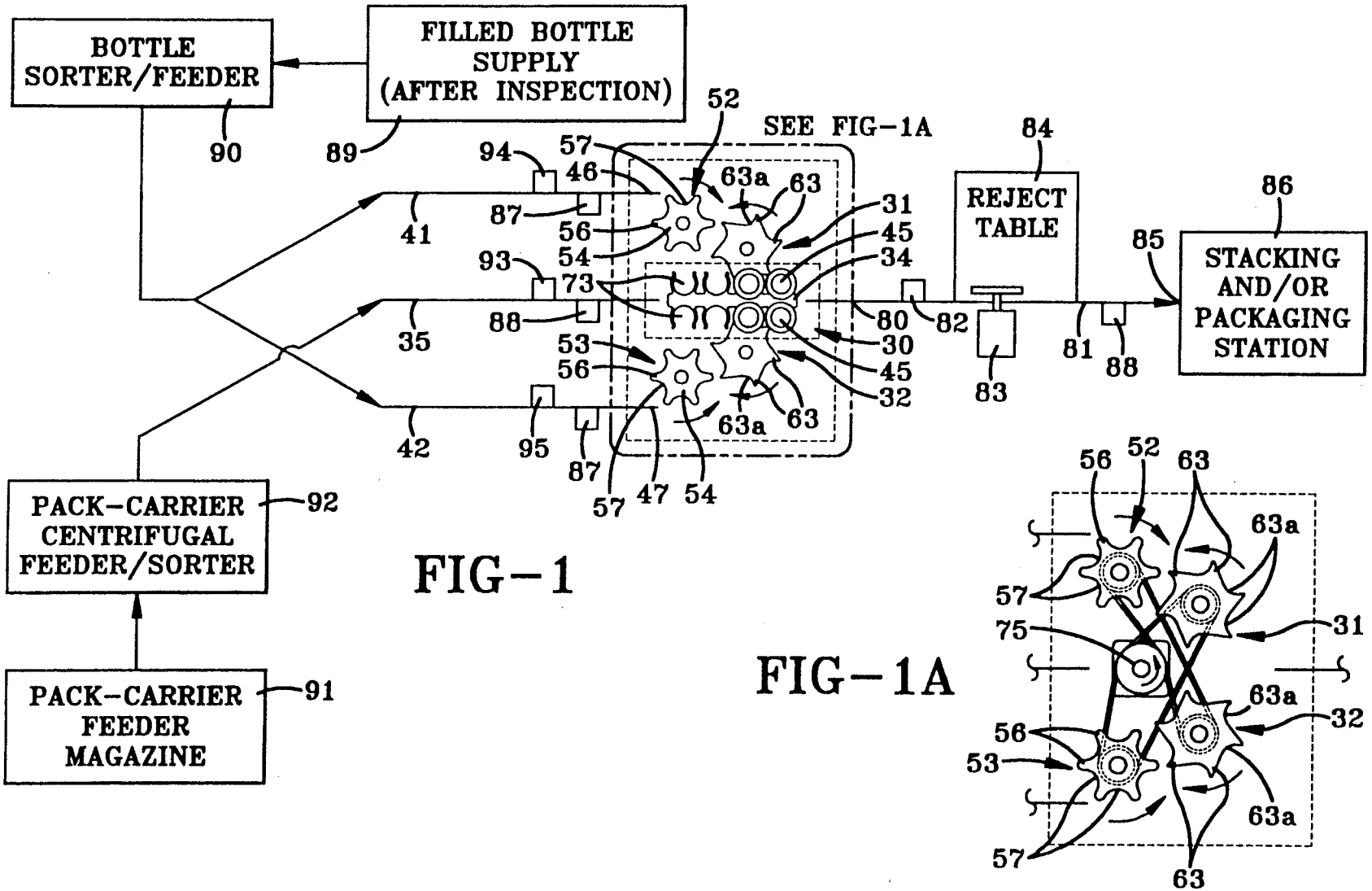
FIG. 1 is a schematic block diagram of the overall apparatus of the invention.
FIG. 1A is a fragmentary schematic diagram of means for rotating coordinately the two application starwheels and associated metering starwheels shown in schematic FIG. 1.
Figure 2:
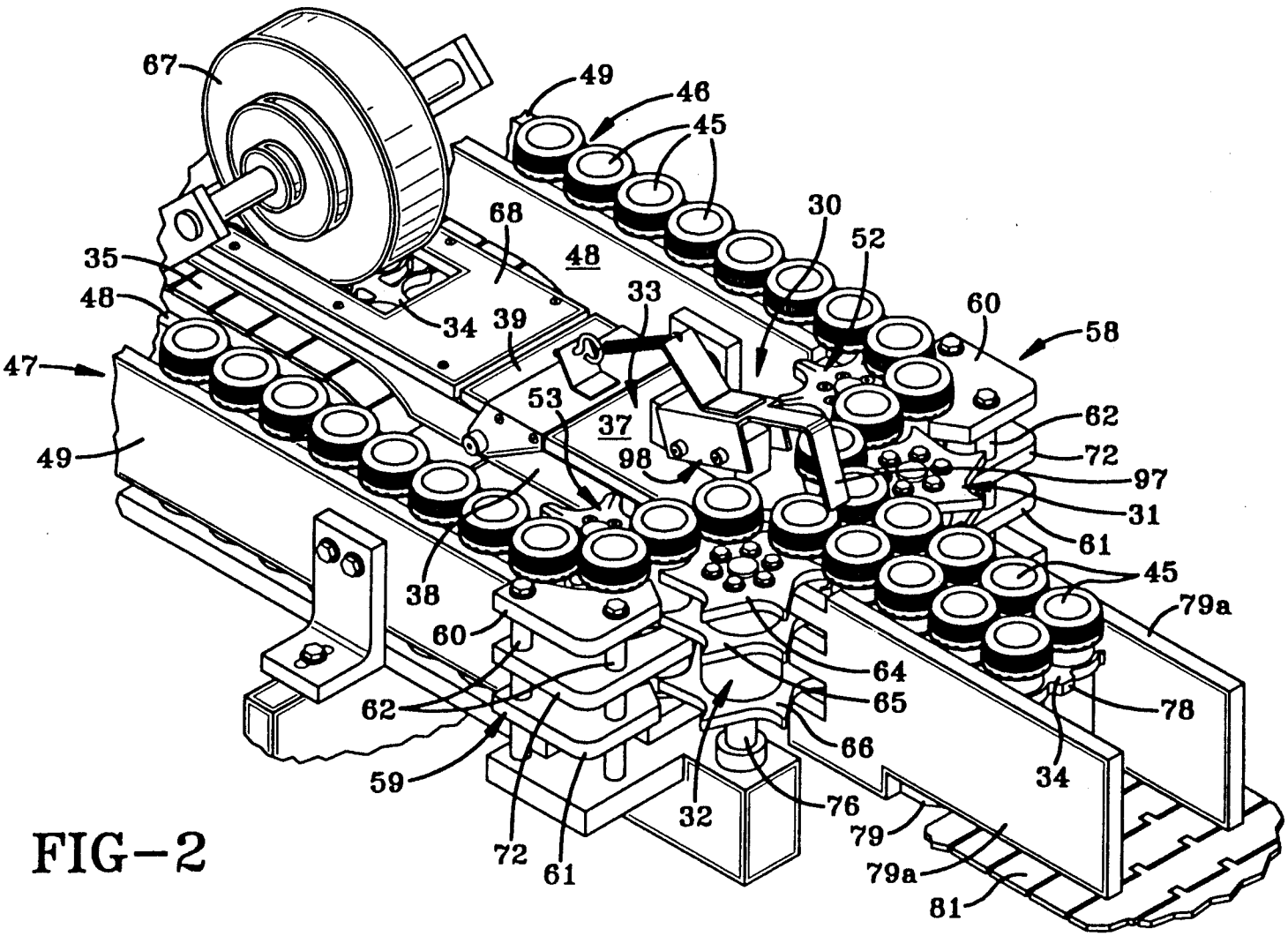
FIG. 2 is an isometric fragmentary view of the present apparatus showing just the loading station area and the conveyors leading to and away from the loading station, with bottles moving through the apparatus.
Figure 3:
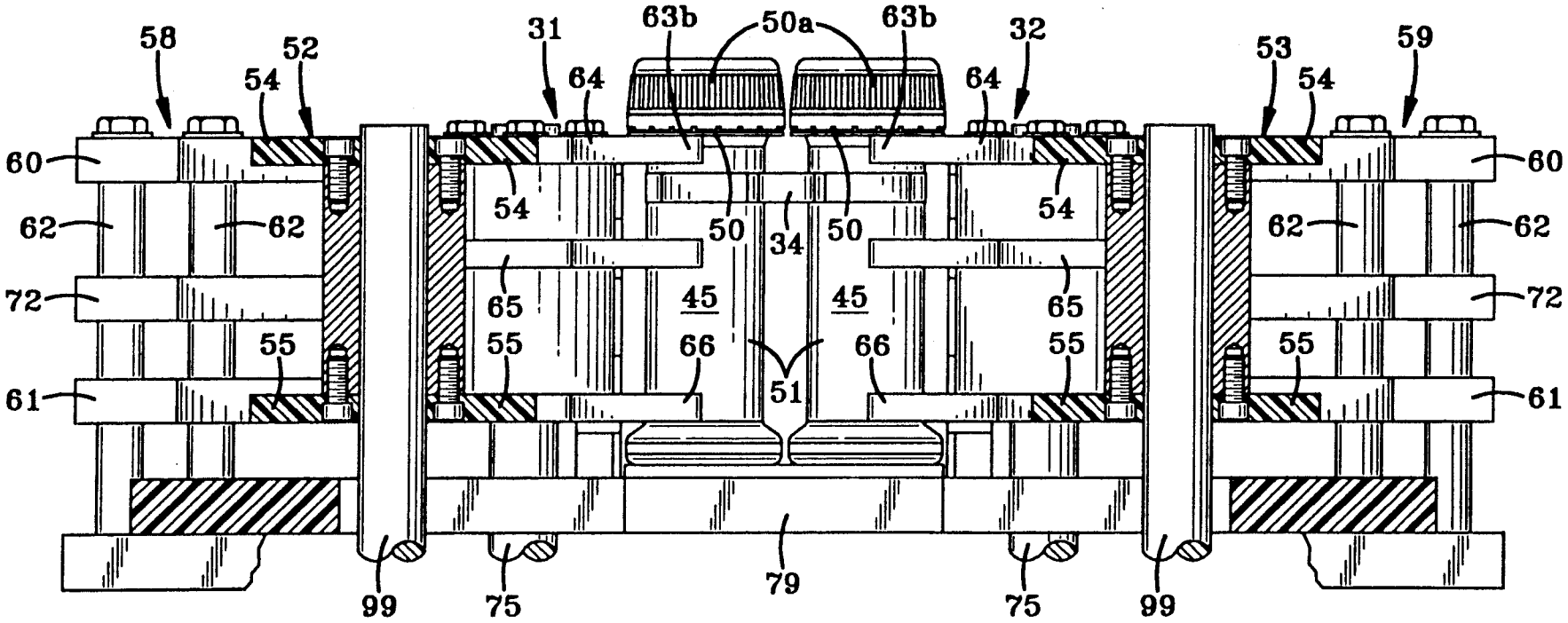
FIG. 3 is a view in section through the loading station taken along line 3—3 of FIG. 4A, the bottles in transition from the metering starwheel to the application starwheel being omitted for purposes of illustration.
Figure 3A:
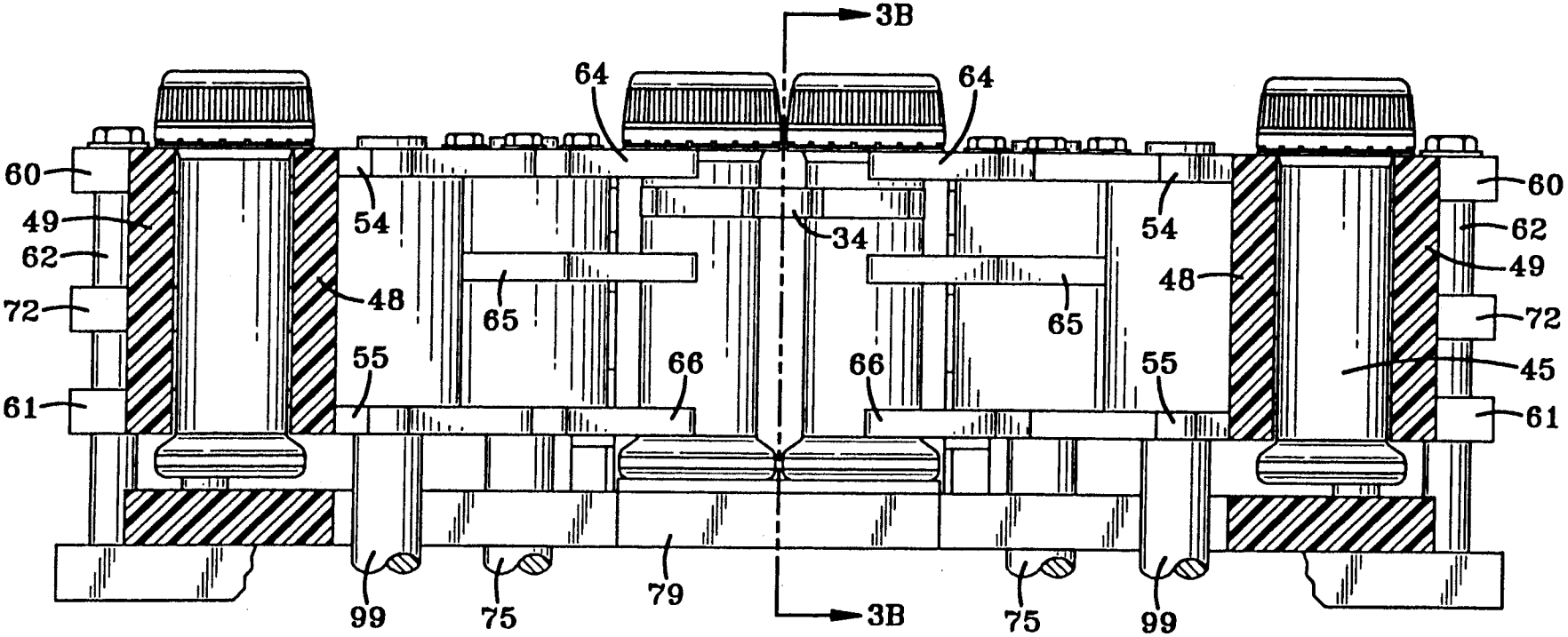
FIG. 3A is a view in section similar to FIG. 3 but just upstream of the loading station taken along the line 3A—3A of FIG. 4A.
Figure 3B:
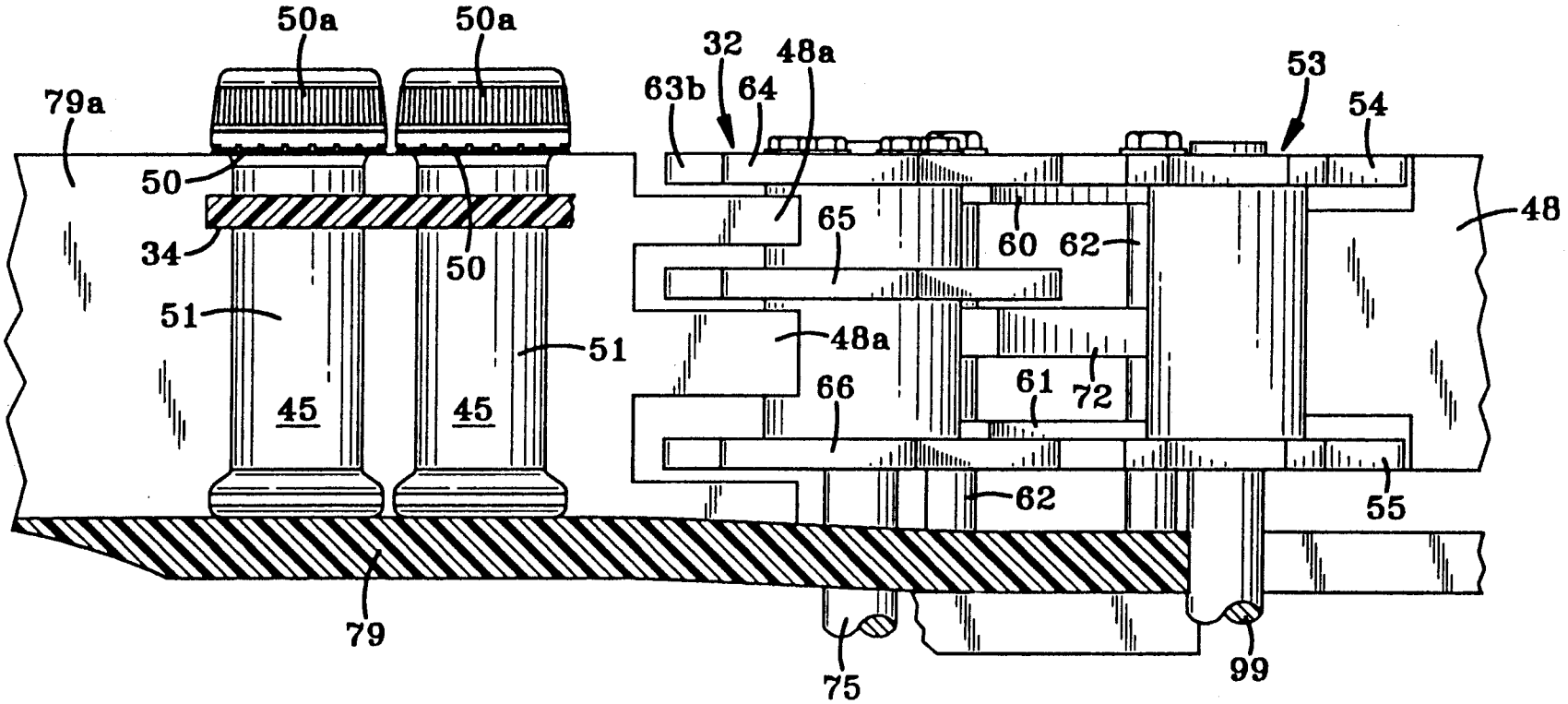
FIG. 3B is a view in section taken along line 3B—3B of the sectional view in FIG. 3A.
Figure 4:
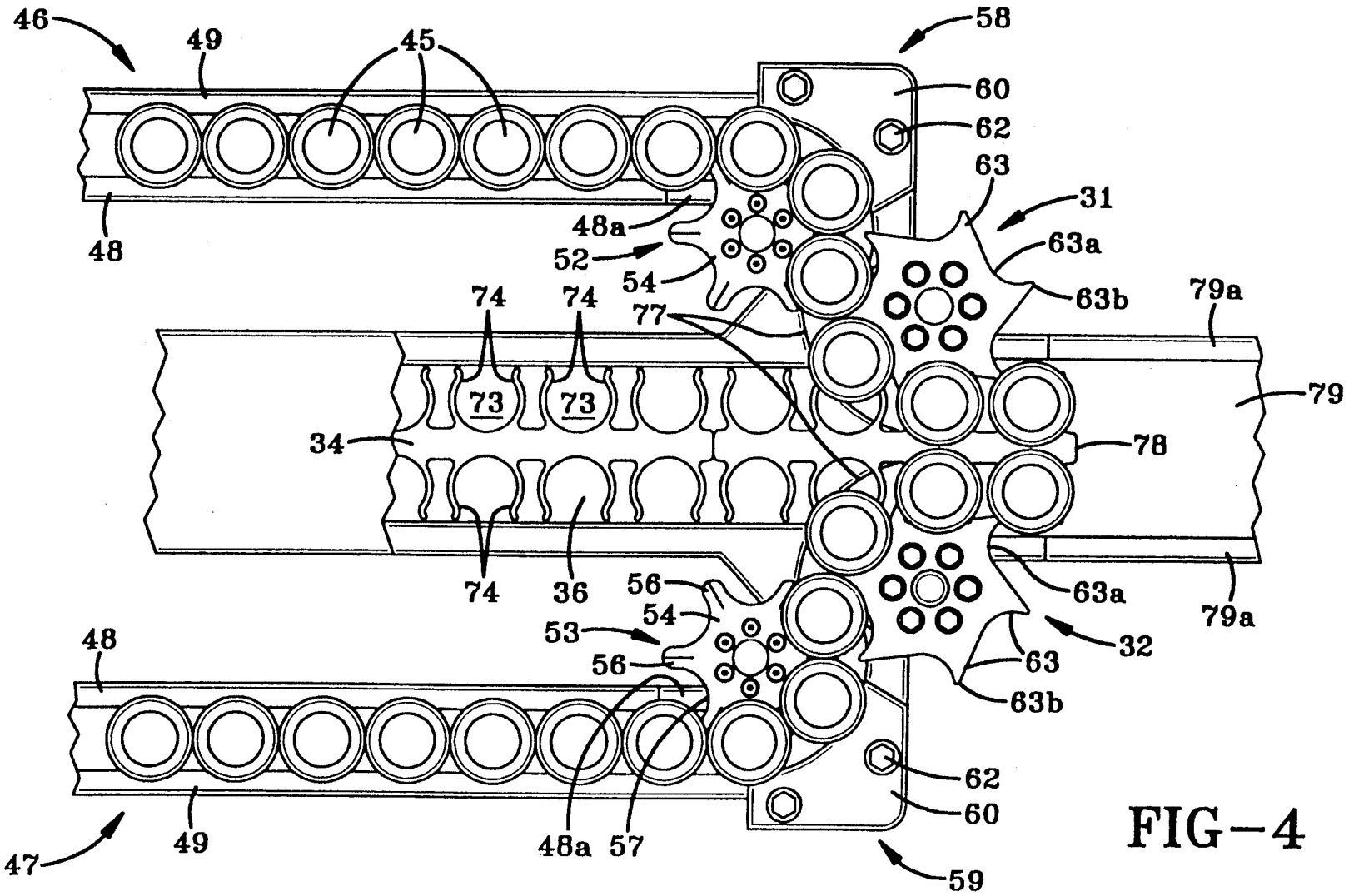
FIG. 4 is a fragmentary plan view of the loading station area and conveyors shown in FIG. 2 depicting a pack carrier being loaded with four bottles already inserted and two more being forced into the back to back pockets or clips.
Figure 4A:
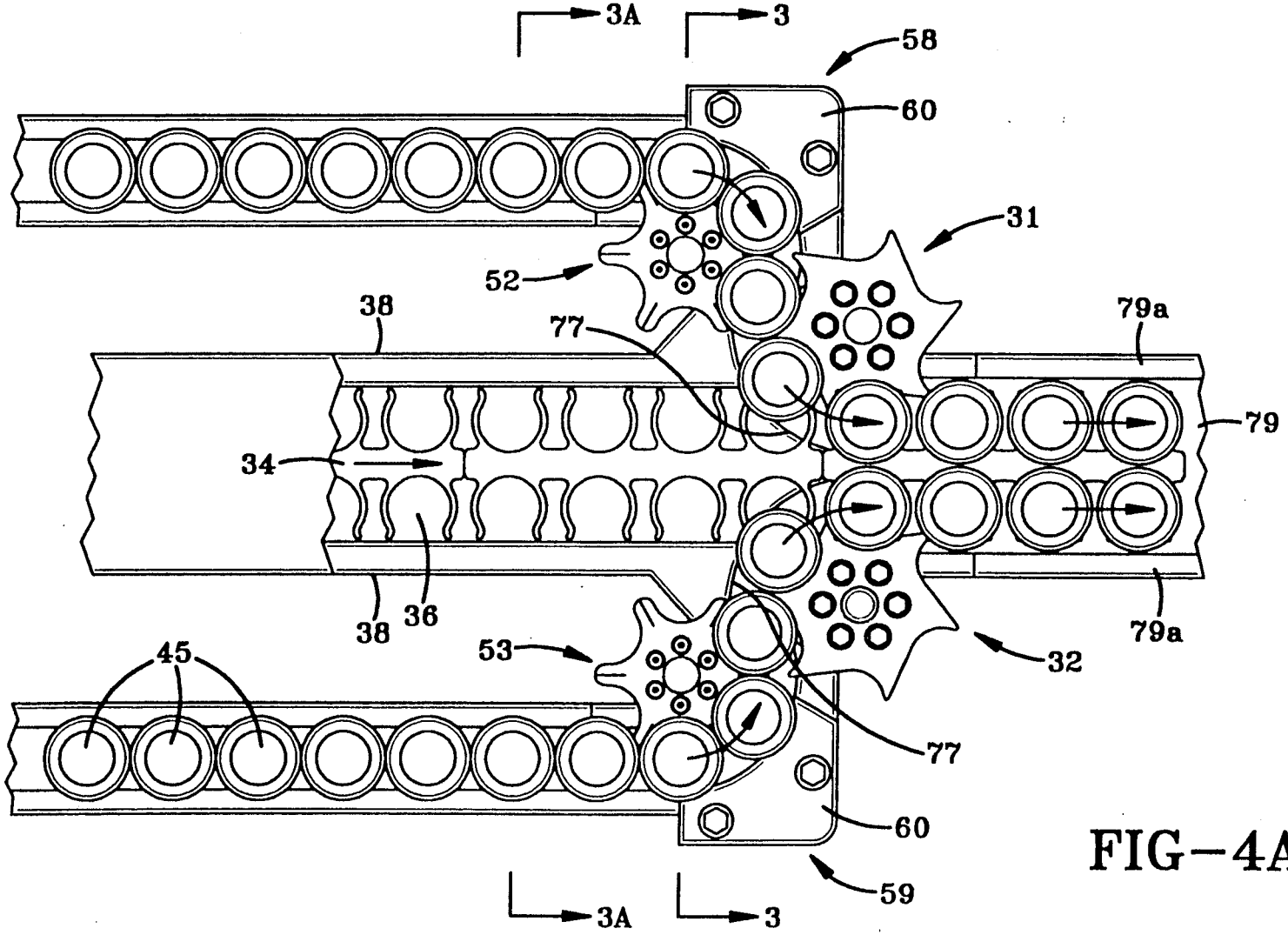
FIG. 4A is a fragmentary plan view as in FIG. 4, but with the pack carrier fully loaded and about to be pushed away from the loading zone.
Figure 4B:
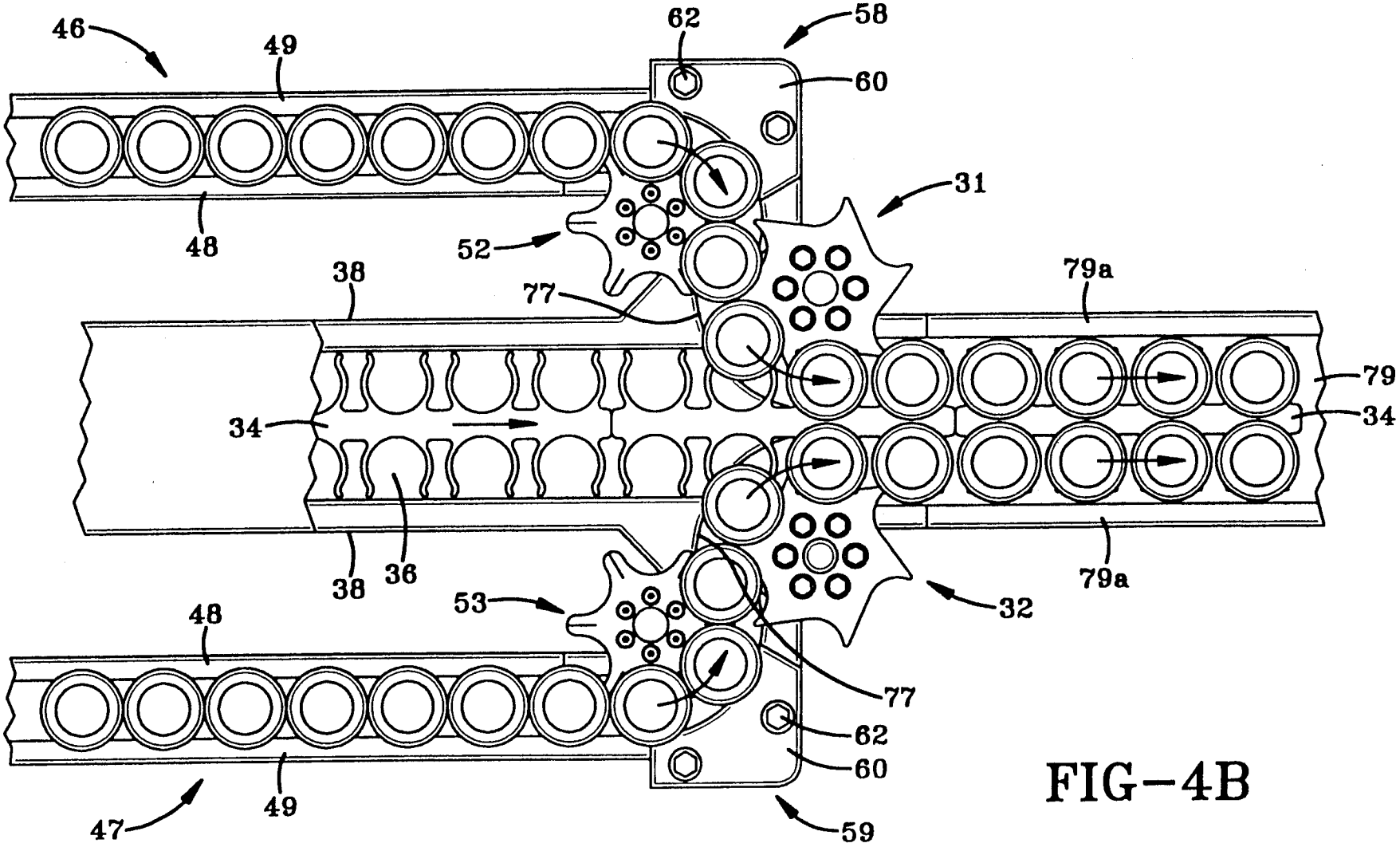
FIG. 4B is a fragmentary plan view as in FIGS. 4 and 4A, but with the first pack carrier fully loaded and being pushed downstream by the next pack carrier which follows head to tail and already has four bottles inserted therein.

Referring now to FIGS. 1 and 1A, showing the present apparatus schematically, and FIGS. 2, 3, 3A, 3B, 4, 4A and 4B, showing in fragmentary isometric, sectional and plan views some of the details of the loading station area, the present apparatus is seen to include a loading station area 30 in which are located two spaced apart application starwheels 31,32, one on either side of an enclosed zone 33. Pack carriers 34 to be loaded are brought by first conveyor 35 to the enclosed zone 33 in single file and oriented in the longitudinal direction of the carrier bodies, and touching head to tail, i.e., so as to be contiguous. The endless belt of the conveyor 35 delivers the pack carriers to an upper slidable surface 36 within the enclosed zone 33 where the pack carriers are shoved along by the pack carriers following on the conveyor 35. To assure the contiguous head to tail relationship of successive pack carriers 34, it is highly preferable to employ an idler hold-down wheel 67, positioned as shown in FIG. 2 to extend through an opening in the cover 68 and ride on the pack carriers sufficiently that the conveyor 35 keeps the pack carriers snugly against those ahead downstream. The hold-down wheel 67 is provided with a ratchet like mechanism that allows the wheel to rotate only one way, with the perimeter surface moving with the pack carriers moving downstream. The cover 68 over conveyor 35 prevents the pack carriers from sliding one up over the other and generally need extend only to the enclosed zone 33 and a short way upstream from the hold-down wheel. The upper slidable surface 36 extends below upper hold-down guide means 37 and between the sidewalls 38 of the enclosed zone 33 and between the upstream end 39 and the downstream end 40 thereof. The sidewalls 38 serve as guides to keep the pack carriers headed between the respective application starwheel means 31,32 which are located at the downstream end 40 and on respective sides of the enclosed zone 33.

Second and third conveyors 41,42, each advance, to the area of the loading station 30 and to respective sides 43,44 thereof, and on respective sides of the first conveyor a continuous single file of the filled bottles 45 to be loaded into the pack carriers 34 by the respective application starwheels 31,32. Conveyors 41,42 deliver the respective single files of bottles 45 to respective chutes 46,47. As seen more particularly in FIG. 3A, each chute consists of a pair of lateral guide members or walls 48,49 extending substantially parallel in the downstream direction from the end of a respective conveyor 41,42 and spaced apart to permit the passage of the bodies of bottles 45 slid therebetween but close enough together that the bottles are each carried on the top edges of the chutes, during sliding, by the closure rims 50 just below the screw caps **50*a* or other cap closure. The rims 50 must be of greater diameter than the upper body or neck portion 51** of each bottle.

Figure 12:
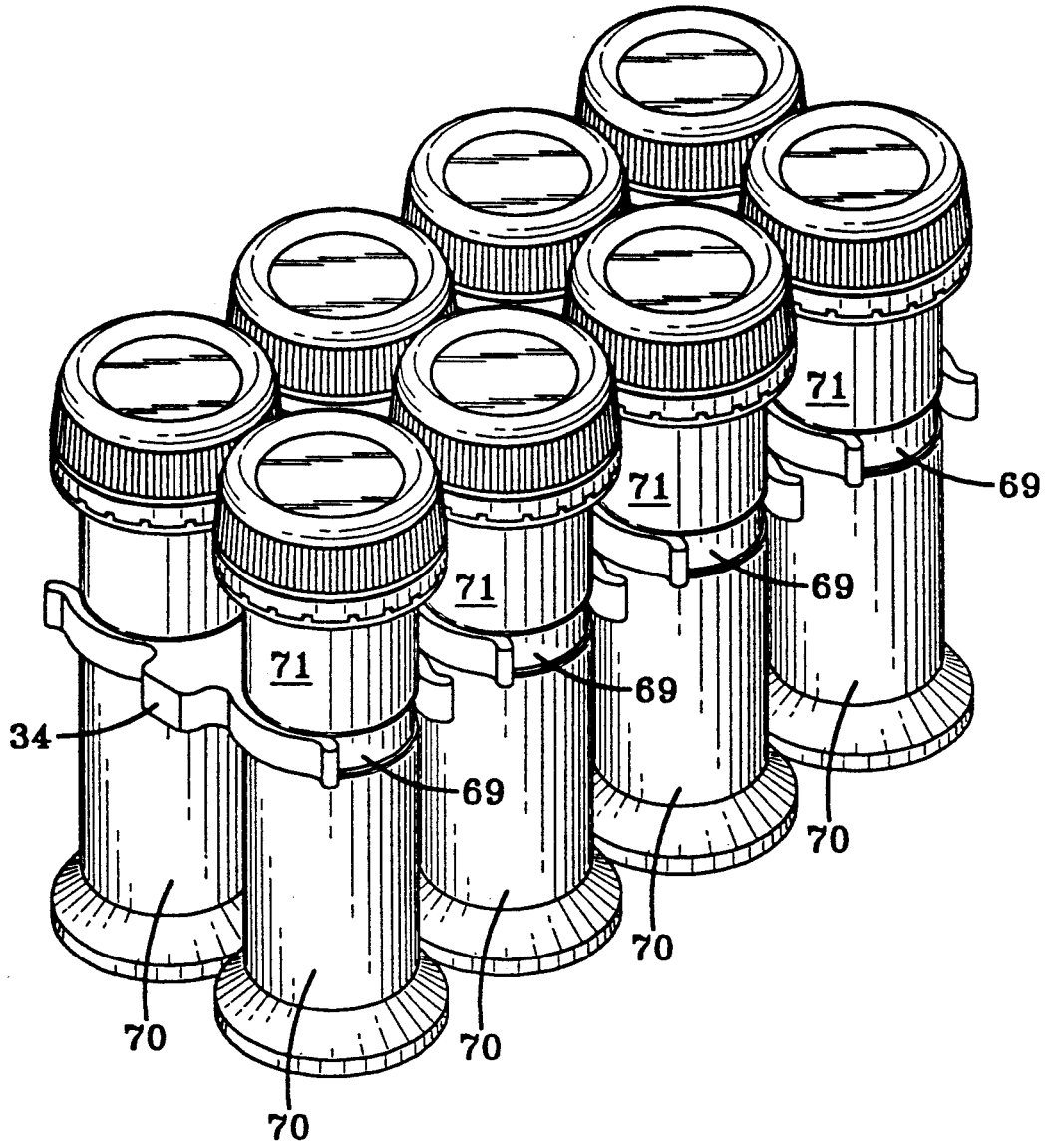
FIG. 12 depicts in isometric view a pack carrier loaded according to the invention with bottles with an annular groove just above mid-height of the bottles, the grooves being carrier pocket-receiving grooves that are smaller in diameter than the lower edges of the body portions just above the grooves.
Figure 13:
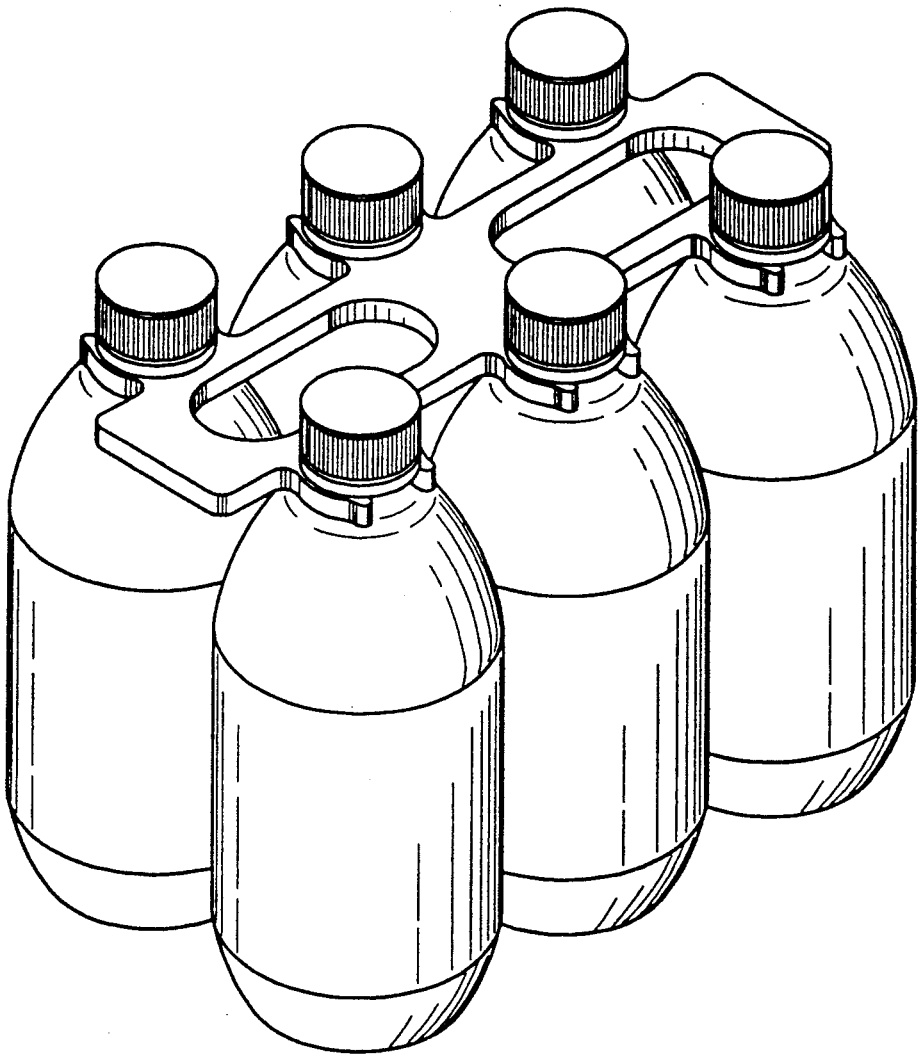
FIG. 13 depicts in isometric view a pack carrier loaded, according to the invention, with a smaller number of larger bottles each having a smaller neck portion just below the rim of the bottle screw cap closure.

When the bottles being advanced through the chutes have a neck portion narrower than the body, it is necessary to use chutes with lateral walls 48,49 of small enough vertical depth, no greater than about the length of the neck portion, so that the bodies of the bottles are not rejected while the rims thereof are slideably supported on the top edges of the walls 48,49. Wherein the bottles have an annular groove 69, such as that seen in the bottles 70 in FIG. 12, the chutes 46,47 respectively must have top edges that are flanged mutually inward from each side sufficiently to engage the annular grooves 69 so that the bottles will be carried on the top edges of the chutes, the bottom edge of the larger diameter body portion 71 above the groove 69 sliding on the flanged top edges of the chutes.

The chutes 46,47 are preferably made of substantially rigid rectangular sheets of a plastic material upon which the lower edges of rims 50 or larger body portions 71 slide readily enough that the filled bottles can be shoved along by the bottles that follow on the respective conveyors 41,42. Suitable plastic materials include polyurethane and nylon.

As indicated the bottles to be inserted into pack carriers using the apparatus and method of the invention must have a no-neck substantially cylindrical body or a substantially cylindrical neck portion adjacent a larger diameter rim just below the closure or an annular groove below a larger diameter body portion. The bottles for a given run using a given set of starwheels and chutes must be of substantially the same size and shape, and preferably very closely the same size and shape.

By no-neck substantially cylindrical body is meant a bottle body of uniform diameter from the bottom to the rim just below the closure.

As seen more particularly in FIGS. 2, 4, 4A and 4B, bottles 45 of each respective series sliding through respective chutes 46,47 are each intercepted individually by a metering starwheel 52,53. Each of the metering starwheels has at least two coaxially spaced star-shaped elements, an upper element 54 and a lower element 55, that rotate coaxially with the shaft 99 on which they are mounted. The star-shaped elements 54,55 ordinarily have six uniformly spaced symmetrical arms 56 of equal length, with pockets 57 therebetween, though fewer or more arms may be appropriate for use in metering larger or smaller bottles in order to provide for proper sized pockets. The inner lateral chute walls 49 adjacent the metering starwheels are each notched out and slotted to provide finger-like extensions **49*a* that interdigitate with the rotating arms 56** of the respective metering starwheels.

Respective curved guide means 58,59 extend from about the ends of the walls 48 of the chutes 46,47 along an arc concentric to the path of the tips of the arms 56 of the metering starwheels 52,53 with enough room between the guide means and the metering starwheels for a bottle 45 in each pocket 57. The respective guide means 58,59 serve to help direct the bottles coming through the respective metering starwheels to the respective application starwheel means 31,32 immediately adjacent. Each guide means consists of at least an upper curved element 60 and a lower curved element 61 vertically spaced apart and joined by one or more supporting posts 62. Preferably each guide means also has an intermediate height curved element 72 that extends downstream of the bottle travel tangentially from the arc described by arms 56 to the arc described by the arms 63 of the star-shaped elements 64 of the respective application starwheels 31,32.

The curved guide means 58,59,72 serve to keep bottles in the respective pockets 57 of the respective metering starwheels 52,53 until the point of rotation is reached where the arms 63 of star-shaped elements 64,65,66 of respective counter-rotating starwheels 31,32 pick off the bottles 45 in succession from the pockets 57 of the respective metering starwheel 52 or 53. The star-shaped elements 64,65,66 are coaxially spaced apart vertically on a rotatable shaft 76, each element 64 being uppermost and positioned to rotate with the arms 63 thereof just above the lateral opening pockets or clips 73 along each side of each successive pack carrier 34 emerging from the enclosed zone 33 where the carriers slide on surface 36. Each element 65 is positioned or spaced downward sufficiently, slightly more than the thickness of the pack carriers to permit the pocket portions of the pack carriers to slide thereabove, while element 66 is usually spaced downward almost to the level of the bottoms of the bottles 45 being loaded in order to maintain good control of the bottles. During rotation of the application starwheels 31,32, the arms 63 of the star-shaped elements, as they move just above and below the pockets 73 of the respective pack carriers 34, move concurrently with the pack carrier in the downstream direction. Respective successive bottles 45 arriving in the respective pockets 63a between respective arms 63 of the star-shaped elements and carried by their rims 50 overlapping the upper edges of the pockets 63a of respective upper elements 64 are forced into successive pockets 73 of the pack carrier, back to back pockets being loaded or filled simultaneously from each side. The starwheels are spaced sufficiently close to leave, as a spacing, a bottle no-neck body or neck portion width or diameter between the depth of each back to back pocket 73 of the pack carrier being loaded and the depth of the pockets 63a of the respective adjacent star-shaped elements 64,65,66. When the movement of the pack carriers 34 is properly indexed to the rotation of the star-shaped elements 64,65,66, and the speed of rotation of the application starwheels is carefully adjusted to the downstream speed of the pack carriers, the bottles 45 are loaded or nested rather precisely into the pockets 63a that are aligned with pockets 73 on each side of the pack carrier 34. Adjustment of the exact shape of the cam-like surfaces of the pockets 63a is important to smooth operations.

The star-shaped elements 64,65,66 generally have six arms evenly spaced apart, though fewer or more arms may be used for bottles with larger or smaller diameter no-neck bodies or neck portions. The pockets 63a are preferably not symmetrical as is the case with the pockets 57 of the star-shaped elements 54,55 of the metering starwheels. Rather, the pockets 63a are shaped to provide a cam-like action, with each pocket being deepest closer to the arm that follows the pocket during rotation to securely force the bottle in the pocket 63a between the paired gripping members 74 defining each pocket 73 of the pack carrier. When the dimensions of the arms 63 are carefully selected by experience, the arm 63 that follows the application starwheel pocket 63a, in each instance, on both sides of the pack carrier, engages the bottle just lodged in the pocket 73 and moves the pack carrier 34 a specific incremental distance downstream to index the pack carrier properly for the next bottle insertion. Minor adjustments to the shape and depth of each pocket 63a and length of arms 63 allow precise indexing. The power drive means 75 that rotate the respective shafts 76 of application starwheels 31,32 must be coordinated so that bottles 45 are inserted simultaneously into back to back pockets 73 of the pack carriers 34, or the pack carriers will tend to be twisted around a bit and out of precise alignment. The power drive means 75 for the rotation of the shafts of the metering starwheels 52,53 must also be carefully coordinated with the drive means rotating the application starwheel means 31,32 so that the transfer of bottles from the metering starwheels to the application starwheels takes place smoothly and reliably.

To keep the bottles riding on the application starwheels 31,32 in the respective pockets 63a, the star-shaped elements 64,65,66 on both sides of the loading station 30 rotate closely adjacent respective curved guide means 77 at the end of the enclosed zone 33 and in the upstream direction from each application starwheel . Each curved guide means 77 may take the form of a lateral surface that is curved concentrically to the arc described by the tips 63b of the arms 63 of the star-shaped elements 64,65,66 when they are rotated, spaced apart from the associated application starwheel sufficiently to accommodate the bottle held in each pocket 63a and extending from about where the bottles are transferred from the adjacent metering starwheel 52 or 53 to the respective application starwheel 31,32, to about the midline of the longitudinal central section 78 of the respective advancing pack carriers.

The curved guide means surfaces 77 each extend down to a lower substantially flat, slidable surface 79 that extends substantially horizontally except for a slight uptilt away from the enclosed zone 33. If desired, the slidable surface 79 may be provided with lateral upstanding walls or guides 79a to prevent straying of loaded pack carriers. Preferably, the ends of these lateral walls adjacent the rotating application starwheels are slotted to allow interdigitated rotation of the arms 63 of the application starwheels therewith. Pack carriers 34, loaded as they are advanced out of the enclosed zone 33 by the application starwheels 31,32 on respective sides, are further pushed to a discharge point 80 by the loaded pack carriers that follow. Assembly or packaging means may receive the loaded pack carriers at the discharge point. More usually, the lower slidable surface 79 is beveled to smoothly meet a fourth conveyor means 81 at the discharge point 80 so that the loaded pack carriers are taken past an optical sensor 82 that detects unfilled pockets and activates a reject mechanism 83 that pushes defectively filled pack carriers laterally onto a reject table 84 for corrective handling. All other pack carriers are carried to the end 85 of the fourth conveyor means 81 to means 86 for a stacking and/or packaging operation.

Each of the conveyors employed are conventionally operated with a drive sprocket 87,88 and one or more idler sprockets, not shown, as may be required. Each drive sprocket is powered by suitable drive means of adequate horsepower, usually an electric motor. To assure necessary coordination mutually between the line speeds of both bottle conveyors as well as with the conveyor for the pack carriers it may be desirable to power all three of these conveyors from the same drive means.

Referring again to the schematic representation in FIG. 1, the filled bottles to be loaded are conveyed from a filled and capped bottle supply area 89, after appropriately close inspection, to most any suitable bottle sorter-feeder 90 wherein bottles in groups or clusters are made to slide into two separate consecutive, single file series. This may be done by directing the bottles down an inclined broader conveyor through a gradually narrowing directing chute to a section with a longitudinally extending dividing wall that separates the bottles into two separate and substantially equal single files.

The pack carriers are supplied from a pack carrier feeder magazine 91 or other suitable source to a feeder-sorter 92 in which the pack carriers are sorted out and directed therefrom consecutively with the central section of each oriented in the direction of travel with the bottle- receiving pockets 73 extending laterally to the line of travel. A suitable feeder-sorter is one of a type conventionally available for this kind of operation, generally, in which the pack carriers are placed upon a rotating table within a bowl shaped container, the pack carriers being moved by centrifugal forces to the outside of the table and against the outer curved wall of the container from which they are led off through a tangential outlet that accepts only the longitudinally directed pack carriers. The sorted pack carriers are led by the first conveyor means 35 to the enclosed zone 33 of the loading station 30, and more specifically, to and at the level of the upper slidable surface 36. A suitable sensing device 93, such as an optical sensor, is positioned along the conveyor 35 not far from the loading station 30 to detect any gaps in the head-to-tail sequence of pack carriers and the signal from the sensor is used to alert the operator or to automatically stop the loading operation until the gap is closed or the problem corrected.

The sorted single files of bottles 45 are directed onto the second and third conveyor means 41,42, respectively, and moved in consecutive order on each conveyor means to the respective chutes 46,47, one conveyor and chute on each side of the first conveyor 35 on which the pack carriers are advanced. The bottles reaching the chutes arrive with the bottoms at about the level of the lower slidable surface 79 in order to have the rims 50 or upper body portions 71 at the proper level to be loaded into the pack carriers 34 with the rims or upper body portions just above the upper surface of each pack carrier. Along each conveyor means 41,42 bringing the bottles in single file order to the loading station 30, there is a sensing device 94,95, usually an optical sensor, located not far from the loading station 30, for detecting any gaps in the needed consecutive, single file order of bottles. As with the pack carriers, the signal from either sensor may be used to alert the operator or to automatically stop the loading operation until the situation is corrected.

Figure 5:
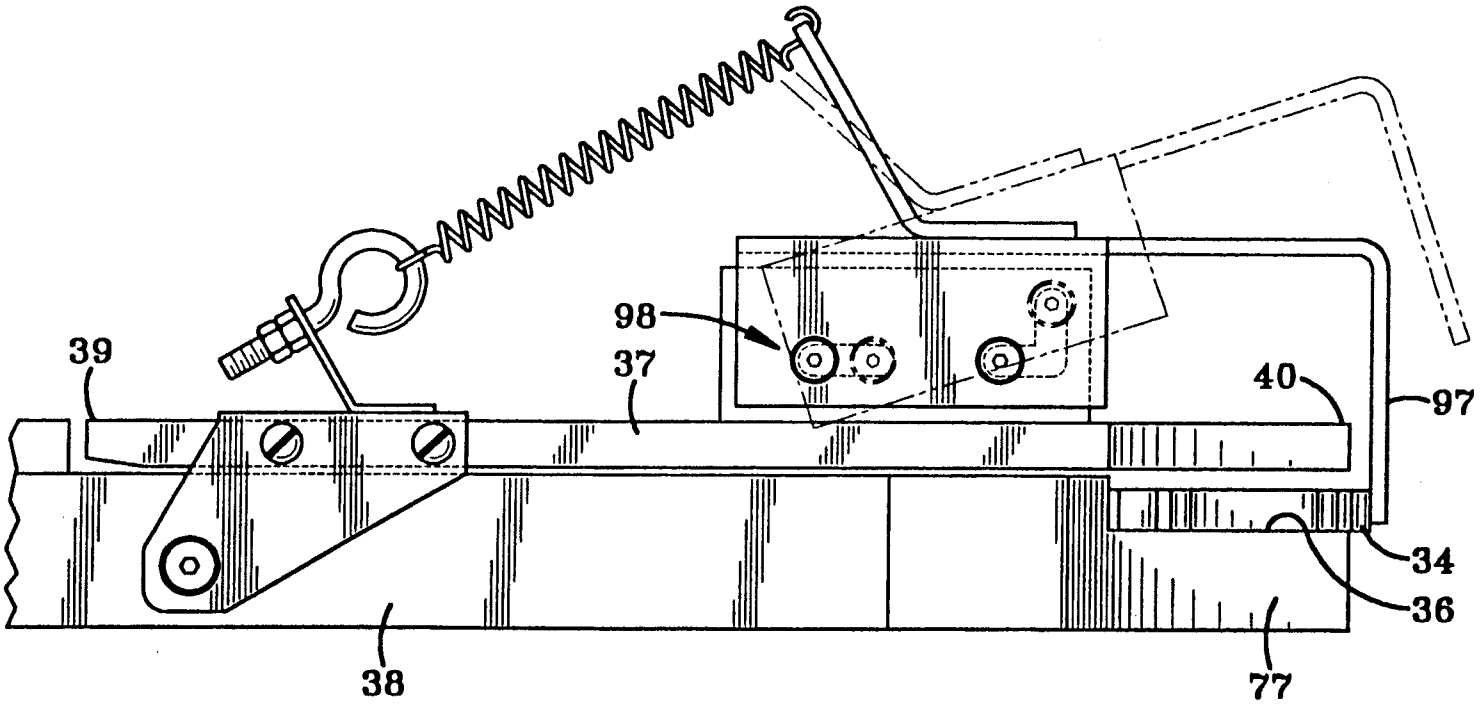
FIG. 5 is a view in side elevation of a form of hold down cover for the enclosed zone, showing the trip mechanism that may be used for safety seasons during a run start up.
Figure 6:
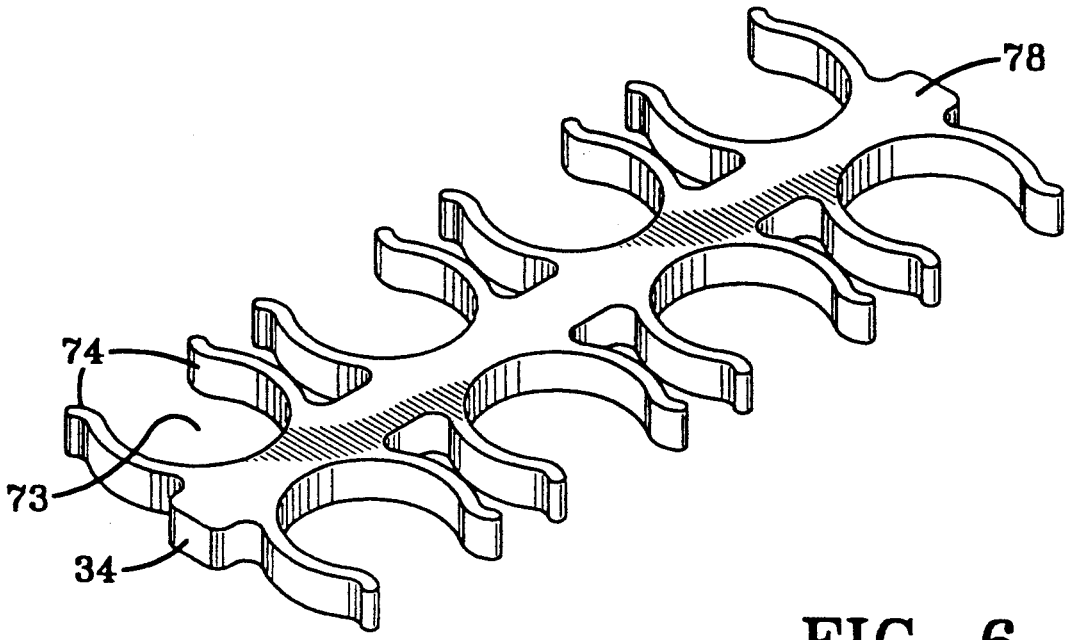
FIGS. 6, 7, 8 and 9 illustrate in isometric view some of the various pack carriers disclosed in the said pending application that may be loaded using the present apparatus and method.
Figure 7:
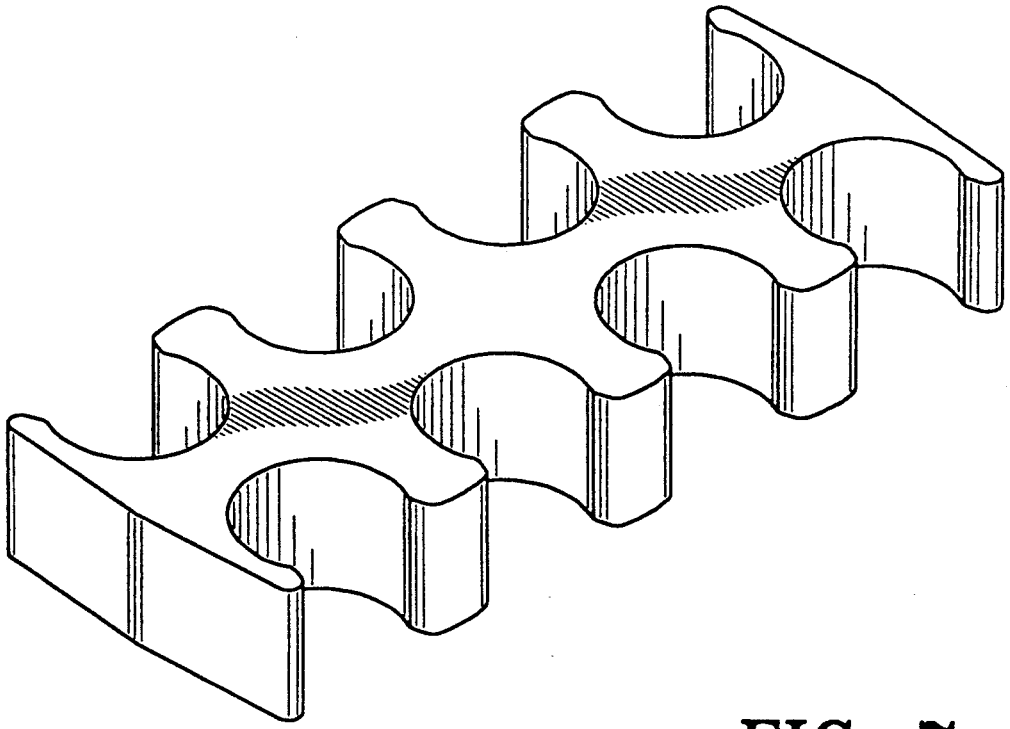
Figure 8:
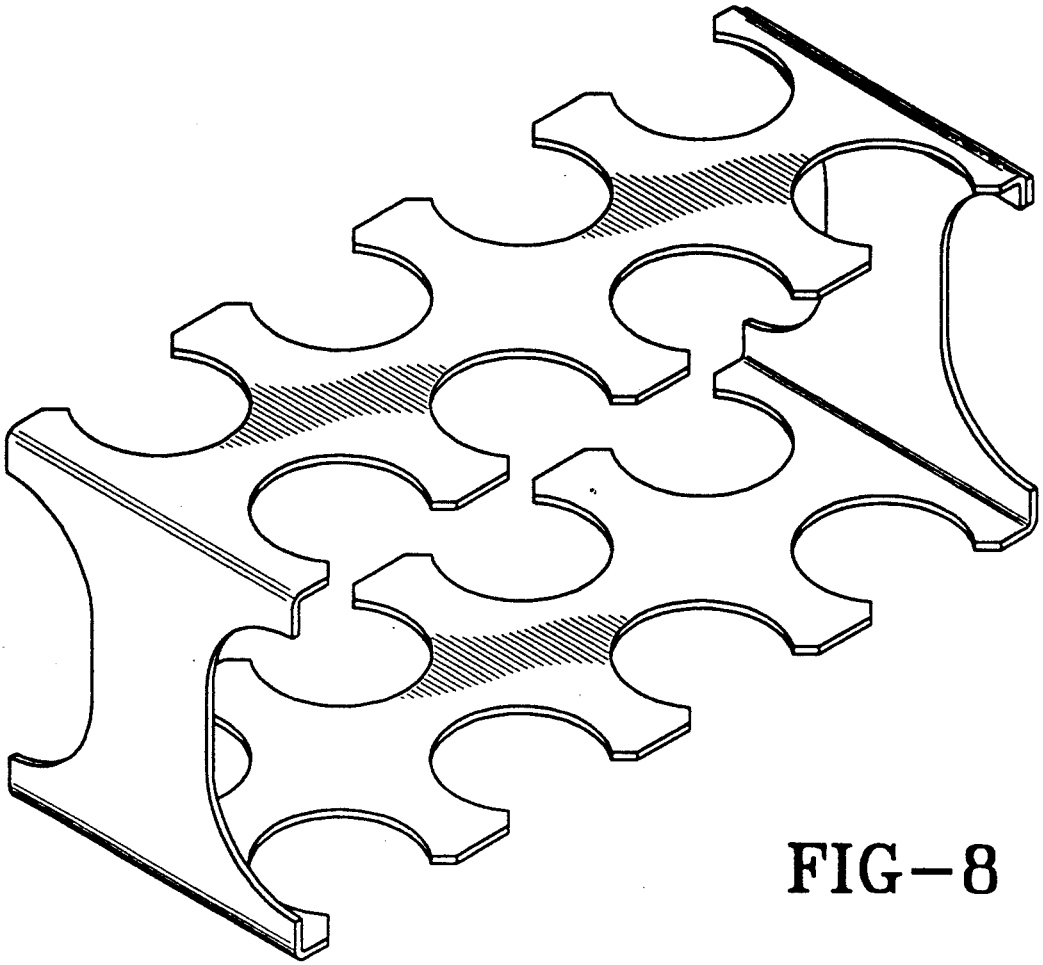
Figure 9:
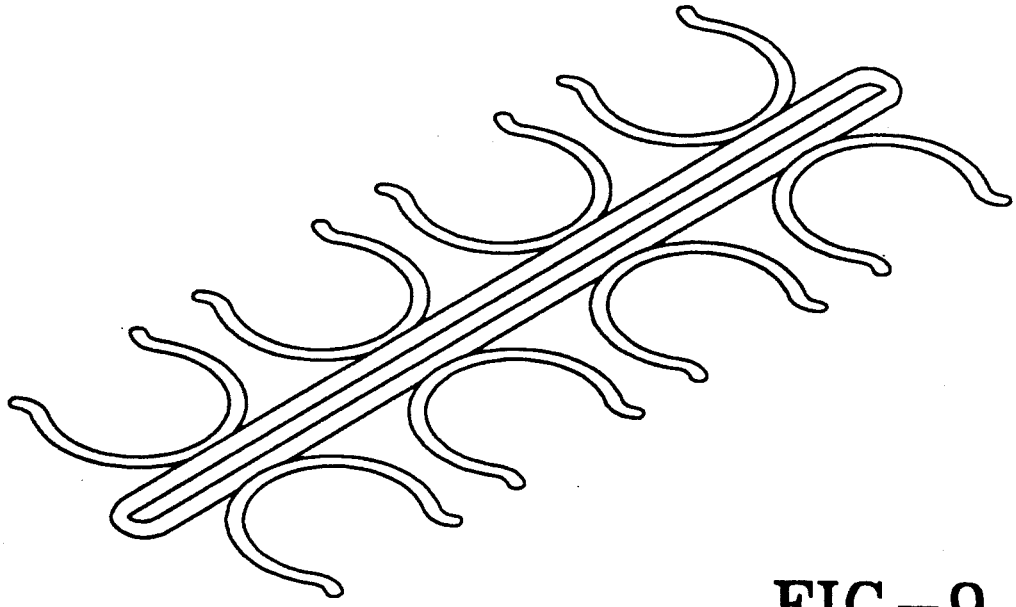
Figure 10:
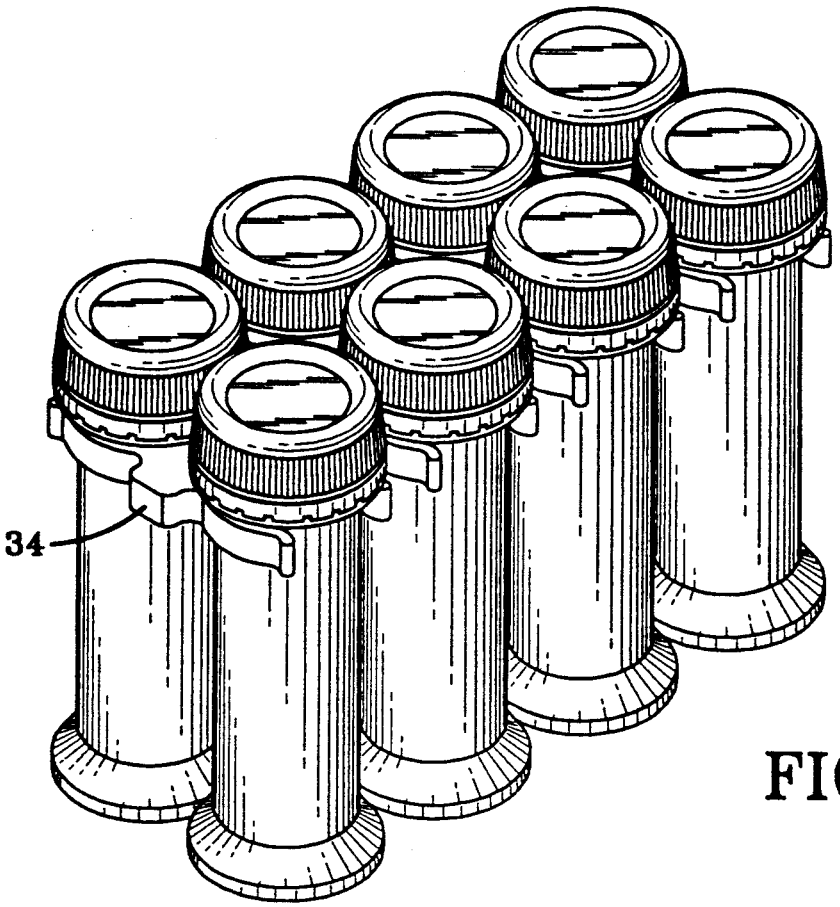
FIG. 10 depicts in isometric view a pack carrier loaded with no-neck bottles using the apparatus and method of the invention.
Figure 11:
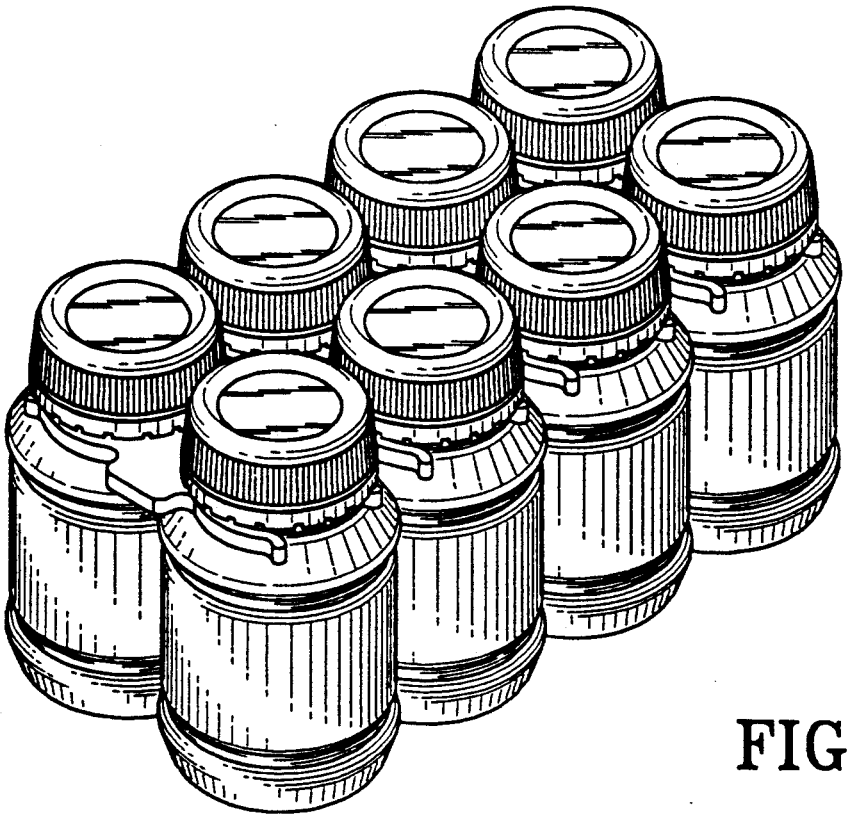
FIG. 11 depicts in isometric view a pack carrier loaded, with bottles with neck portions just below and of smaller diameter than the closure rim, using the apparatus and method of the invention.

The upper hold-down cover or guide means 37 over the enclosed zone 33 may be seen in FIGS. 2 and 5 positioned across the lateral sidewalls 38 that are at the sides of the upper slidable surface 36. The guide means serves to keep the pack carriers 34 from bucking up one over the other. Preferably, the upper guide means 37 is hinged to the sidewalls 38 at the upstream end of the guide means 37 and is provided with a stop element lever 97 that restrains pack carriers 34 momentarily from passing out of the enclosed zone. The stop element or lever 97 is provided with a trip mechanism 98 that responds to moderate pressure on the lever 97 and a coil spring bias that pivots and holds the lever 97 up out of the way of the pack carrier and subsequent pack carriers during continuing operations. In order to start up the present apparatus and begin proper indexing and coordination of the movement and positioning of the pack carriers and application starwheels, two bottles of the type to be loaded are placed manually in the first two back to back pockets of the first pack carrier in the loading zone before the power means are activated. The arms 63 of the application starwheels then engage these two bottles and move the pack carrier incrementally forward indexing the carrier for the next bottle insertions, and indexing and insertions then proceed automatically, as desired. If start up is begun with a pack carrier with bottles in the first two pockets it is not necessary to load these manually. However, to assure proper indexing from the start, it is usually necessary to restrain the first pack carrier to assure indexing and no gaps between successive pack carriers. Use of the upper guide means 37 with the stop element lever 97 with the trip mechanism 98 described is highly preferred for safety reasons over manually restraining the first pack carrier at start up.

Using the present apparatus and method, bottles in the 10 to about 350 gram (about 1 to 12 oz.) contents capacity range may be readily loaded into pack carriers therefor holding from about 4 to about 12 bottles each in back to back arrays, 2 to 6 bottles on each side. These bottles may be loaded into pack carriers of the type herein described at a rate of up to 240 bottles per minute for the larger bottles, and up to 1000 bottles per minute for the smaller bottles. More usually, bottles in the range of about 55 to about 230 grams (2 to 8 oz.) contents capacity may be loaded into pack carriers holding from 4 to 8 bottles, 2 to 4 per side, at a rate of at least 200 bottles per minute and up to about 800 bottles per minute, with an assured capability of up to 600 bottles per minute with most equipment.

In order to have loaded pack carriers that are convenient for most users, and for assured success of loading operations according to the present invention, either or both of the gripping members of the pack carriers and the bottles must be made of a resilient material that facilitates inserting the bottles into and removing them from the pockets of the pack carriers without undue force required. It is ordinarily sufficient if one or the other is formed of a resilient material such as polyethylene terephthalate. The pack carrier may also be formed of a metal such as aluminum, copper, brass or a ferrous metal, if the bottles are made of a resilient polymeric plastic.

Usually, the bottles are made of glass and the pack carrier is made of a polymeric material such as clear polyethylene terephthalate glycol copolymer, high impact polystyrene, polyvinyl chloride, polyethylene terephthalate or other durable polymeric material that is resilient and suitable for molding the pack carriers in a single piece. Advances have been made in developing polymeric compositions for bottles containing liquid compositions for human consumption and such bottles are conveniently loaded using the present invention.

I claim:

1. Apparatus for high speed assembly of capped bottles into pack carriers therefor, each bottle being filled with a composition and having a substantially cylindrical pack carrier-receiving body or neck portion that is smaller in diameter than the portion of the bottle immediately thereabove and the bottles being of uniform size and shape, and the pack carriers each having opposed linear arrays of laterally opening clips or pockets in which the pockets are aligned in back to back pairs and into which the bottles are resiliently inserted and held, comprising:

(a) a pack carrier loading station having a substantially enclosed zone with open upstream and downstream ends, lateral walls serving as guide members, a cover serving as an upper, hold-down guide member, and a lower base guide member extending from the downstream end for supporting bottles in pack carriers after the pack carriers emerge from the enclosed zone during loading at the downstream end, the lower base guide member having an upper flat surface on which the bottles in a loaded pack carrier are slidable to a discharge point;

(b) spaced apart first and second rotatable application starwheels immediately adjacent the downstream end of the loading station at laterally opposed sides of the enclosed zone, respectively, and the lower base guide member extending under both of the adjacent application starwheels, each application starwheel having an upstream intake side and each starwheel having an associated curved guide means extending along an arc on the upstream side toward the loading station;

(c) spaced apart first and second rotatable metering starwheels immediately adjacent the upstream intake side of respective application starwheels and each spaced outwardly therefrom and having an upstream intake side and corner guide means for directing respective bottles to the adjacent application starwheel;

(d) first and second chutes each leading respectively to the upstream intake side of one of the starwheels, each chute having opposed lateral sides with top edges, the top edges being spaced closer together than the diameter of the bottle body portions immediately above the substantially cylindrical pack carrier-receiving body or neck portions whereby bottles pushed through the respective chutes are slidingly suspended on the top edges, the lateral sides being spaced apart sufficiently for ready movement therebetween of any larger body portions of the bottles below the substantially cylindrical pack carrier-receiving body or neck portions;

(e) first and second spaced apart conveyor means each extending from a source of the bottles to a respective chute, and each being adapted for simultaneously advancing a respective single file series of the bottles to a respective chute, wherein neither chute has a floor sufficiently shallowly located, so that when the bottles in each series are shoved through their respective chute by the action of the respective conveyor means on bottles that follow, the bottles in the chutes are suspended by the lower edges, of the bottle body portions immediately above the smaller diameter pack carrier-receiving substantially cylindrical body or neck portion, riding on the top edges of the lateral sides of the chute wherein they move;

(f) third conveyor means extending from a source of the pack carriers in between the first and second conveyor means to the upstream end of the loading station, and being adapted for advancing to the loading station a single file series of pack carriers coordinately with sufficient of both bottle series to completely fill each successive pack carrier, the pack carriers being advanceable by the conveyor means with the pockets opening laterally with respect to the line of advancement of the conveyor means;

(g) the enclosed zone of the loading station having extending longitudinally therethrough between the ends thereof a substantially flat, level surface on which the pack carriers are slideably and contiguously receivable from the third conveyor means and on which the pack carriers are slidable just prior to loading, and during loading while emerging from the loading station, the flat, level surface extending substantially between the lateral walls, below the upper hold-down guide member, and above the lower base guide member;

(h) each starwheel having drive means therefore adapted to controllably coordinately rotate each metering starwheel counter to the adjacent application starwheel;

(i) the respective metering starwheels and application starwheels each having at least an upper and a lower coaxial star-shaped element with equally spaced arms with pockets between the arms and the upper star-shaped elements each having perimeter top edges, the metering starwheels being each adapted to serially receive each bottle, supplied thereto by a respective chute, and to carry each bottle between a pocket of the metering starwheel and the associated curved guide means to the associated application starwheel during rotation of the starwheels, the bottles being carried during movement of the starwheels by the portion of each bottle above the substantially cylindrical pack carrier-receiving portion overlapping the perimeter top edge of a pocket and adjacent arms of an upper star-shaped element of a starwheel;

(j) the spacing between each metering starwheel and its associated application starwheel being such and the coordination of rotation of the starwheels being controllable such that the bottles delivered to the application starwheel are, during a portion of the coordinated rotation of the respective starwheels, confined serially in aligned pockets defined by the arms of opposed star-shaped elements;

(k) each application starwheel being adapted during rotation to move each of a series of bottles received consecutively from its associated metering starwheel between a pocket of the application starwheel and the associated curved guide means upstream thereof to a consecutive series of pack carriers emerging from the loading zone and, together with the application starwheel on the opposed side, simultaneously laterally insert consecutive bottles into consecutive back to back pockets of each pack carrier, the pockets of the star-shaped elements of the application starwheel being shaped to have a cam-like action for inserting the bottles, and the arms of the application starwheels on respective sides being adapted to bear against bottles just inserted and to cooperatively move each pack carrier along as each back to back pocket is filled, and to slide the pack carrier out of the enclosed zone as loading is being completed and thence out of the loading station; and (l) the star-shaped elements of the respective application starwheels being spaced apart sufficiently to readily permit movement therebetween of the continuous series of pack carriers just below the level of the respective uppermost star-shaped elements while being sufficiently close for the arms and pockets thereof to force successive bottles into successive nesting pockets on both sides of each pack carrier whereby each pocket is loaded with a bottle, each starwheel rotating upon a substantially vertical axis, and, a portion of each application starwheel star-shaped element extending into the loading zone and such portion moving during rotation in the downstream direction;

at least one of the pack carriers as a group and the bottles as a group being formed of a resilient material.

2. The apparatus of claim 1 in which the application starwheels both have three star-shaped elements spaced apart on a substantially vertical rotatable shaft, and the metering starwheels having at least two star-shaped elements on a substantially vertical rotatable shaft, the spacing of the star-shaped elements permitting interdigitated rotation of the starwheels past the guide means adjacent to each.

3. The apparatus of claim 1 in which the third conveyor means adjacent to and leading up to the enclosed zone is provided with a cover spaced sufficiently above the conveyor means for passage of the pack carriers to be loaded.

4. The apparatus of claim I including additionally a fourth conveyor for moving loaded pack carriers away from the lower slidable surface.

5. The apparatus of claim 1 having drive sprockets for each conveyor means and controllable power means for turning the drive sprockets coordinately.

6. The apparatus of claim 1 adapted to load bottles having a contents capacity in the range of about 10 to about 350 grams into pack carriers therefor.

7. The apparatus of claim 1 adapted to load bottles having a contents capacity of about 55 to about 230 grams into pack carriers therefor.

8. The apparatus of claim 1 capable of loading bottles of about 10 to about 350 grams content capacity into pack carriers therefor at a rate of from 240 bottles per minute for the 350 gram content bottles to about 1000 bottles per minute for the 10 gram capacity bottles.

9. The apparatus of claim 1 capable of loading bottles of about 55 to about 230 grams contents capacity into pack carriers therefor at a rate in the range of about 200 to about 800 bottles per minute.

10. The apparatus of claim 1 further including a hold-down wheel riding on the consecutive series of pack carriers adjacent and upstream of the loading station and positioned to press the pack carriers against the third conveyor means, the hold-down wheel having means preventing the wheel from rotating backwards to the downstream direction.

11. Apparatus for the high speed assembly of capped bottles, while filled with a composition, into pack carriers therefor wherein the bottles to be assembled are of substantially the same size and shape and have a substantially cylindrical no--neck body or a cylindrical neck portion and with a closure with a rim that is larger in diameter than the no-neck body or the neck portion, and the pack carriers have a longitudinal central section from which extends a plurality of back to back aligned pairs of laterally opening clips or pockets into which the bodies or necks of the bottles are adapted to be resiliently inserted sideways and resiliently held, the apparatus comprising:

(a) an enclosed zone with an open upstream end and an open downstream end, lateral walls, an upper hold-down guide member and an upper substantially level slidable surface extending between the ends;

(b) two spaced apart application starwheels at each side of the downstream end of the enclosed zone, each with a plurality of coaxial, layered star-shaped elements on a common rotatable shaft with arms and pockets between the arms and each with associated curved guide means to retain bottles in the pockets thereof along a circumferential arc on the upstream side of each application starwheel;

(c) power means for controllably and coordinately rotating the two application starwheels simultaneously;

(d) means for feeding a consecutive single file series of pack carriers across the upper slidable surface of the enclosed zone and between the two application starwheels in the longitudinal direction of the pack carriers and at a level just below the uppermost arms of the star-shaped elements, the two application starwheels being sufficiently close together that the deepest parts of the pockets between the arms of the star-shaped elements are substantially a bottle no-neck body or neck diameter width from the deepest parts of the pockets of a pack carrier to be passed therebetween, and the arc of each guide means extending substantially to the path of the pack carriers, and the arms of the starwheels moving in the downstream direction when rotated with the arms of respective layered elements extending immediately above and below the path of the pack carriers;

(e) means for supplying first and second consecutive single file series of the bottles simultaneously to each starwheel, respectively; and (f) indexing means for closely aligning the moving pockets on each side of advancing pack carriers with the moving pockets of the respective application starwheels rotating during such advancing, the pockets between the arms of the star-shaped elements being shaped to provide a cam--like action to force each bottle carried in a pocket of each application starwheel in turn into an aligned pocket of a pack carrier moving out of the enclosed zone between the application starwheels, the indexing means providing for simultaneously forcing bottles into back-to-back pockets of the pack carriers; and (g) the arms of the star-shaped elements during rotation being adapted to bear against each successive bottle just loaded into a pack carrier to shove the pack carrier incrementally downstream for loading the next back to back bottles and moving the fully loaded pack carrier out of the loading station to a discharge point.

12. The apparatus of claim 11 in which the means for supplying first and second series of the bottles to the respective application starwheels includes a respective metering starwheel for each application starwheel and associated curved guide means for directing bottles to the pockets of the application starwheels.

13. The apparatus of claim 11 further including a flat slidable surface downstream of the loading station on which the bottles of loaded pack carriers are slid away from the loading station, and lateral guide means along the sides of the flat slidable surface.

14. Apparatus for the high speed assembly of capped bottles, while filled with a composition, into pack carriers therefor wherein the bottles to be assembled are of substantially the same size and shape and have a substantially cylindrical no—neck body or a cylindrical neck portion and a closure with a rim that is larger in diameter than the no-neck body or the neck portion, and the pack carriers have a longitudinal central section from which extends a plurality of back to back aligned pairs of laterally opening clips or pockets into which the bodies or necks of the bottles are adapted to be resiliently inserted sideways and resiliently held, the apparatus comprising:

(a) an enclosed zone with open upstream and downstream ends and with a substantially level slidable upper floor surface extending therethrough, and a substantially level slidable lower support surface extending downstream therefrom;

(b) an application starwheel at each side of the downstream end of the enclosed zone, each starwheel with associated retentive curved guide means;

(c) a metering starwheel with associated retentive curved guide means adjacent each application starwheel;

(d) means for feeding a substantially contiguous series of bottles to each metering starwheel;

(e) means for feeding a substantially contiguous series of pack carriers into the enclosed zone and across the slidable upper floor surface to the downstream end thereof;

(f) the application starwheels each having at least upper, lower and intermediate level star-shaped elements with equally spaced arms and pockets between the arms;

(g) the respective application starwheels being spaced apart sufficiently for the pack carriers to slide therebetween, but close enough that bottles carried in the pockets of the application starwheels are forced into the aligned pockets of each successive pack carrier simultaneously from each lateral side of the pack carrier;

(h) the starwheel pockets having perimeter edges and the edges being shaped to have a cam-like action to force the bottles into the pack carrier pockets during rotation of the application starwheels; and (i) the rotation of each of the application starwheels being coordinatable, with that of their respective associated metering starwheel to effect consecutive transfers of bottles, and, with the advance of each successive pack carrier to accomplish alignment with and insertion of bottles into the pockets of the pack carrier, the arms of the application starwheel being adapted to move during rotation to push repetitively downstream on successive pairs of bottles just inserted back to back into the pack carrier being loaded, each time moving the pack carrier an incremental distance and indexing the pack carrier position into the alignment needed to receive the next succeeding bottle from each side into back to back pack carrier pockets.

15. A method of high speed loading of bottles while filled with a composition, into pack carriers therefor wherein the bottles to be assembled are of substantially the same size and shape and have a substantially cylindrical no-neck body, or a cylindrical neck portion, and are closed with a screwcap that is larger in diameter than the no-neck body or neck portion, and the pack carriers having a longitudinal central section from which extends a plurality of back-to-back aligned pairs of laterally opening clips or pockets into which the bodies or necks of the bottles are resiliently inserted sideways and resiliently held, the method comprising the steps of:

(a) providing a loading station with an enclosed zone open at the upstream end and the downstream end and with lateral walls and an upper hold-down guide member and a substantially level upper slidable surface extending therethrough, and, at the downstream end, two laterally spaced apart application starwheels, each with at least three layered star-shaped elements upon an axial shaft, controllable power means for coordinated rotation of the axial shafts, and associated curved guide means adjacent each application starwheel at the upstream side, the star-shaped elements having arms and pockets therebetween;

(b) advancing steadily to the enclosed zone and sliding therethrough on the upper slidable surface to the point of emergence at the downstream end a substantially contiguous single file series of pack carriers in the longitudinal direction;

(c) concurrently rotating the starwheels and supplying to each respective starwheel and its associated guide means a single file consecutive series of bottles received and positioned to fit between the guide means and consecutive pockets between the arms of the star-shaped elements to ride on the application starwheel with the screwcap of each bottle overlapping the upper edge of a pocket of the uppermost star-shaped element;

(d) rotating coordinately the two application starwheels with the arms of the star-shaped elements extending just above and below the path of the adjacent pockets of each pack carrier being sled in between and the so-extending arms moving in the downstream direction during rotation, and the spacing between each application starwheel and each adjacent pack carrier sliding out of the enclosed zone being such that there is a no-neck body or neck diameter width spacing between the deepest part of the pockets of each of the respective starwheels and of the pack carrier being loaded at closest coordinated and indexed approach; and (e) thereby inserting consecutive bottles into consecutive pockets on each side of the pack carrier being loaded, the back to back pockets of the pack carrier being loaded simultaneously; and arms of the star-shaped elements engaging the just-inserted bottles, bottle by bottle, simultaneously on both sides of the pack carrier, moving the pack carrier incrementally downstream and indexing the same to receive the next pair of bottles, and finally advancing each fully loaded pack carrier in turn out of the loading station, permitting the following pack carrier to advance contiguously in indexed fashion to commence loading.

* * * * *

UNITED STATES PATENT AND TRADEMARK OFFICE

CERTIFICATE OF CORRECTION

PATENT NO. : 5,287,677

DATED : Feb. 22, 1994

INVENTOR(S) : Charles M. Hunter

It is certified that error appears in the above-identified patent and that said Letters Patent is hereby corrected as shown below:

Column 1, line 28, delete "to be pending".

Column 13, line 6, "claim I" should be --claim 1--.

Signed and Sealed this

Twenty-eighth Day of June, 1994

*Attest:*

Bruce Lehman

BRUCE LEHMAN

*Attesting Officer*

*Commissioner of Patents and Trademarks*